US010314124B1

(12) United States Patent
Yang et al.

(10) Patent No.: US 10,314,124 B1
(45) Date of Patent: Jun. 4, 2019

(54) LED DRIVING POWER SUPPLY BASED ON 2.4G REMOTE CONTROLLING ADJUSTMENT OF BRIGHTNESS AND COLOR TEMPERATURE

(71) Applicant: Shenzhen Longood Intelligent Electric Co., Ltd, Shenzhen, Guangdong (CN)

(72) Inventors: Xiong Yang, Guangdong (CN); Jun Fang, Guangdong (CN); Yu Luo, Guangdong (CN); Zian Li, Guangdong (CN)

(73) Assignee: Shenzhen Longood Intelligent Electric Co., Ltd, Shenzhen (CN)

( * ) Notice: Subject to any disclaimer, the term of this patent is extended or adjusted under 35 U.S.C. 154(b) by 0 days.

(21) Appl. No.: 16/034,351

(22) Filed: Jul. 13, 2018

(30) Foreign Application Priority Data

May 21, 2018 (CN) ..... 2018 1 0488575

(51) Int. Cl.
*H05B 37/02* (2006.01)
*H05B 33/08* (2006.01)
*G08C 17/02* (2006.01)

(52) U.S. Cl.
CPC ..... *H05B 33/0827* (2013.01); *G08C 17/02* (2013.01); *H05B 33/0887* (2013.01); *H05B 37/0272* (2013.01); *H05B 33/0845* (2013.01); *H05B 33/0857* (2013.01)

(58) Field of Classification Search
CPC ..... H05B 37/0272; H05B 33/0845; H05B 33/0857
See application file for complete search history.

(56) References Cited

U.S. PATENT DOCUMENTS

2012/0146505 A1* 6/2012 Jonsson ..... H05B 33/0857 315/50
2015/0305126 A1* 10/2015 Maeda ..... H05B 37/0281 315/134
2018/0027626 A1* 1/2018 Wang ..... H05B 33/0815 315/186

* cited by examiner

*Primary Examiner* — Thuy V Tran

(57) ABSTRACT

An LED driving power supply based on 2.4 G remote controlling adjustment of brightness and color temperature, comprising: an LED driving circuit, connected between an output end of an AC power supply and an LED light source, and the LED light source comprises at least two sets of LED lamp strings with different color temperatures connected in parallel; a brightness adjustment circuit, connected to the LED driving circuit, for adjusting the current input to the LED light source by the LED driving circuit according to an input PWM signal; a color temperature adjustment circuit, connected to a loop of the LED driving circuit and the LED light source, for adjusting the current input to each LED lamp string according to an input PWM signal; a main control circuit, respectively outputting PWM signal to the brightness adjustment circuit and/or the color temperature adjustment circuit to control the operation of both.

12 Claims, 3 Drawing Sheets

LED DRIVING POWER SUPPLY BASED ON 2.4G REMOTE CONTROLLING ADJUSTMENT OF BRIGHTNESS AND COLOR TEMPERATURE

CROSS REFERENCE TO RELATED APPLICATION

This application claims priority of CN201810488575.0, Chinese patent application filed on May 21, 2018. The contents of CN201810488575.0 are all hereby incorporated by reference.

TECHNICAL FIELD

The present application relates to the field of LED driving power supply, and more particularly, to an LED driving power supply based on 2.4 G remote controlling adjustment of brightness and color temperature.

BACKGROUND

With the advancement of technology and the improvement of people's living standard, intelligent home products have gradually entered the lives of ordinary people. Intelligent home products have become more and more popular to consumers. Traditional lighting products have gradually changed from traditional energy-saving lamp to energy-saving and environment-friendly, long life LED lamp, then to intelligent and customizable LED lamp. With consuming upgrade, intelligent lighting products will gradually become mainstream products; intelligent remote control, stepless adjustment of color temperature, stepless adjustment of brightness, combined control and other functions will be favored by the end consumers.

Currently, on the market, the lighting products with the remote control function mainly use infrared remote control, and the adjustment of brightness and color temperature is basically a segmented adjustment, and infrared remote control mode also has a problem of short distance of remote control, generally only 5-10 m, and it is one-to-one control, cannot simultaneously control multiple groups of lamps, and infrared remote control also has the problem of dead angle of remote control.

In view of this, it is necessary to provide an LED driving power based on 2.4 G remote controlling adjustment that could realize stepless adjustment of brightness and color temperature and long remote control distance to solve the above defects.

SUMMARY

The technical problem to be solved by the embodiments of the present application is to provide an LED driving power based on 2.4 G remote controlling adjustment which could realize stepless adjustment of brightness and color temperature and long remote control distance.

To solve the above technical problem, the embodiments of the present application provide an LED driving power supply based on 2.4 G remote controlling adjustment of brightness and color temperature, comprising an LED driving circuit, a main control circuit, a brightness adjustment circuit and a color temperature adjustment circuit; wherein, the LED driving circuit, connected between the output end of the AC power supply and the LED light source, and the LED light source comprises at least two sets of LED lamp strings with different color temperatures connected in parallel;

the brightness adjustment circuit, connected to the LED driving circuit, for adjusting a current input to the LED light source by the LED driving circuit according to a first input PWM signal;

the color temperature adjustment circuit, connected to a loop of the LED driving circuit and the LED light source, for adjusting a current input to each LED lamp string according to a second input PWM signal;

the main control circuit, the main control circuit integrates a 2.4 G wireless transceiver module and is connected to a 0-10V dimmer, and according to a brightness adjustment and/or color temperature adjustment signal from the 2.4 G wireless transceiver module or a brightness adjustment signal from the 0-10V dimmer, the main control circuit respectively outputs the first and second input PWM signals to the brightness adjustment circuit and/or the color temperature adjustment circuit to control the operation of both. Based on the above design, the main control circuit integrated with a 2.4 G wireless transceiver module is added on the basis of retaining a conventional 0-10V dimmer, and could be connected with an external controller through a 2.4 G RF signal, and according to a brightness adjustment instruction and/or a color temperature adjustment instruction from the external controller, the main control circuit outputs PWM signal to the brightness adjustment circuit and/or the color temperature adjustment circuit, to realize the stepless adjustment of brightness and the stepless adjustment of color temperature of multiple LED lamps.

A further technical solution is: the LED driving circuit comprises AC/DC constant voltage circuit and a Buck step-down constant current circuit; wherein the AC/DC constant voltage circuit comprises a rectifier and filter circuit and a constant voltage circuit sequentially connected between the output end of the AC power supply and the Buck step-down constant current circuit; wherein the Buck step-down constant current circuit comprises a driving chip, an inductor, a first capacitor, a first resistor, and a first transistor, a first diode, a second diode and a short-circuit protection circuit; wherein, an input pin of the driving chip is connected to an output end of the brightness adjustment circuit, and an output pin of the driving chip is connected to one end of the inductor, and the other end of the inductor is connected to an input end of the short-circuit protection circuit and one end of the first capacitor, and the other end of the first capacitor is connected to an output of the short-circuit protection circuit and an anode of the second diode, and the one end of the first capacitor connected to the inductor is being as a positive output of the LED driving circuit, and the other end of the first capacitor is being as a negative output of the LED driving circuit, and one end of the first resistor is connected to a driving pin of the driving chip, and the other end of the first resistor is connected to a gate of the first transistor and a cathode of the first diode, and a drain of the first transistor is connected to the positive output of the constant voltage circuit, and a source of the second transistor, a cathode of the second diode and an anode of the first diode are all connected to ground; wherein the positive output of the LED driving circuit is connected to an anode of the LED lamp strings.

A further technical solution is: the LED driving power supply further comprises a power switch connected between the output end of the AC power supply and the LED driving circuit, and a power switch detecting circuit for detecting the working state of the power switch, and the main control circuit obtains a voltage of an output end of the power switch detecting circuit to adjust the color temperature of the LED lamp strings.

A further technical solution is: the power switch detecting circuit comprises a secondary winding coupled to a primary winding of a transformer of the constant voltage circuit, and a third diode, a second capacitor, a second resistor, a third resistor, a third capacitor, and a fourth resistor and a second transistor; wherein, a dotted terminal of the secondary winding is connected to an anode of the third diode, and a cathode of the third diode is connected to one end of the second capacitor and one end of the second resistor, and the other end of the second resistor is connected to one end of the third resistor, one end of the third capacitor and one end of the fourth resistor, and the other end of the fourth resistor is connected to a gate of the second transistor, and a drain of the second transistor is connected to the main control circuit, and a heteronymous terminal of the secondary winding is connected to the other end of the second capacitor, the other end of the third resistor, the other end of the third capacitor and a source of the second transistor, and is also connected to the negative output of the LED driving circuit.

A further technical solution is: the brightness adjustment circuit comprises a photocoupler, a fifth resistor, a sixth resistor, a seventh resistor, an eighth resistor, a fourth capacitor and a fifth capacitor; wherein, one end of the sixth resistor is connected to the main control circuit, and the other end of the sixth resistor is connected to an anode of a light-emitting diode of the photocoupler, a cathode of the light-emitting diode of the photocoupler is connected to a negative output of the LED driving circuit, and one end of the seventh resistor is connected to an emitter of a phototransistor of the photocoupler, and the other end of the seventh resistor is connected to one end of the fourth capacitor and one end of the eighth resistor, and the other end of the eighth resistor is connected to one end of the fifth capacitor and the LED driving circuit, and the other end of the fourth capacitor and the other end of the fifth capacitor are both connected to ground, and a collector of the phototransistor of the photocoupler is connected to one end of the fifth resistor, and the other end of the fifth resistor is connected to a power supply.

A further technical solution is: the brightness adjustment circuit further comprises a voltage stabilizing circuit, wherein the voltage stabilizing circuit comprises a triple pin regulator and a ninth resistor, and a cathode and a reference electrode of the triple pin regulator and one end of the ninth resistor are all connected to the emitter of the phototransistor of the photocoupler, and an anode of the triple pin regulator and the other end of the ninth resistor are both connected to the ground.

A further technical solution is: the color temperature adjustment circuit comprises at least two switching circuits, and the switching circuits are all connected to the main control circuit, and each switching circuit is correspondingly connected to one LED lamp string.

A further technical solution is: the LED light source comprises two set of LED lamp strings with different color temperatures connected in parallel; accordingly, the color temperature adjustment circuit comprises two switching circuits, and one switching circuit is connected to the main control circuit, and the other switching circuit is connected to the main control circuit through a flip circuit, and each switching circuit is connected to an LED lamp string; wherein, the flip circuit comprises a tenth resistor and a third transistor, and one end of the tenth resistor and a base of the third transistor are both connected to the main control circuit, and a collector of the third transistor is connected to an input end of the corresponding switching circuit, and an emitter of the third transistor and the other end of the tenth resistor are both connected to a negative output of the LED driving circuit.

A further technical solution is: the switching circuit comprises a driving chip, an eleventh resistor, a twelfth resistor, a fourth transistor and an electrolytic capacitor; wherein, an input pin of the driving chip is connected to the main control circuit, and an output pin of the driving chip is connected to one end of the eleventh resistor, and the other end of the eleventh resistor is connected to one end of the twelfth resistor and a gate of the fourth transistor, and a drain of the fourth transistor is connected to a cathode of the LED lamp string and a cathode of the electrolytic capacitor, and an anode of the electrolytic capacitor is connected to a positive output of the LED driving circuit, and a source of the fourth transistor and the other end of the twelfth resistor are both connected to a negative output of the LED driving circuit; wherein, the positive output of the LED driving circuit is connected to an anode of the LED lamp string.

A further technical solution is: the switching circuit further comprises a filter capacitor, and one end of the filter capacitor is connected to the source of the fourth transistor, and the other end of the filter capacitor is connected to the cathode of the electrolytic capacitor.

Compared with the prior art, the embodiments of the present application could realize the brightness adjustment and the color temperature adjustment to the LED driving power supply of the present application through 2.4 G remote control, that is, the main control circuit integrates a 2.4 G wireless transceiver module, and could connect with an external controller through the 2.4 G RF signal. According to a brightness adjustment instruction and/or a color temperature adjustment instruction from the external controller, the main control circuit outputs the PWM signal to the brightness adjustment circuit and/or the color temperature adjustment circuit, to realize a stepless adjustment of brightness and a stepless adjustment of color temperature of multiple LED lamps. The present application remains the traditional 0-10V dimmer, so the present application could also control the luminous intensity of LED lamp strings according to the change of the voltage of the 0-10V dimmer to realize the brightness adjustment function of the LED, which could meet the needs of different users and facilitate the daily use of consumers.

DETAILED DESCRIPTION

Figure 1:
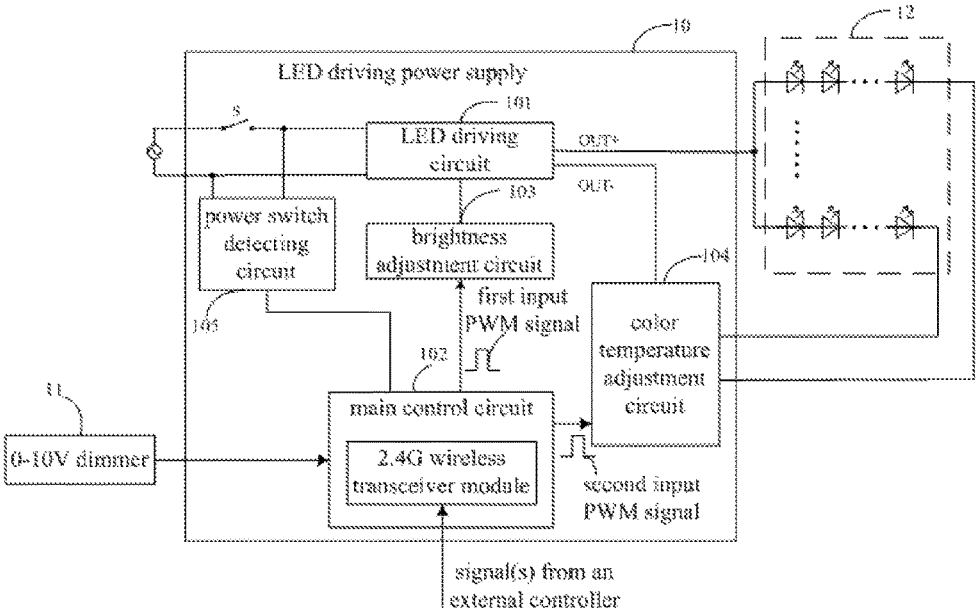
FIG. 1 is a circuit block diagram of the LED driving power supply based on 2.4 G remote controlling adjustment of brightness and color temperature according to an embodiment of the present application.
Figure 2:
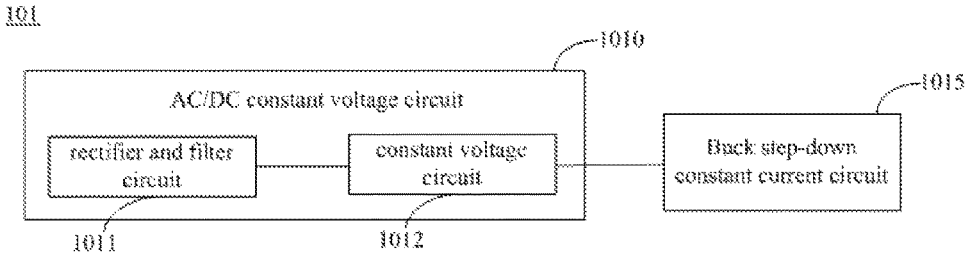
FIG. 2 is a specific circuit block diagram of the LED driving circuit of the present application.

In order that person skilled in the art could more clearly understand the purpose, technical solutions and advantages of the present application, the present application will be further described below with reference to the accompanying drawings and embodiments.

Referring to FIG. 1 to FIG. 4, FIG. 1 to FIG. 4 show an embodiment of the LED driving power supply 10 based on 2.4 G remote controlling adjustment of brightness and color temperature according to the present application. In the embodiment shown by the drawings, the LED driving power supply 10 comprises an LED driving circuit 101, a main control circuit 102, a brightness adjustment circuit 103, and a color temperature adjustment circuit 104, wherein, the LED driving circuit 101 is connected between the output end of AC power supply and an LED light source 12, and the LED light source 12 comprises at least two sets of LED lamp strings with different color temperatures connected in parallel. The brightness adjustment circuit 103 is connected to the LED driving circuit 101, for adjusting the current input to the LED light source 12 by the LED driving circuit 101 according to an input PWM signal, so as to control the emitting brightness of the LED light source 12. The color temperature adjustment circuit 104 is connected to a loop of the LED driving circuit 101 and the LED light source 12, for adjusting the current input to each LED lamp string according to an input PWM signal, so as to control the color temperature of the LED light source 12. The main control circuit 102 integrates a 2.4 G wireless transceiver module and is connected to a 0-10V dimmer 11, and according to a brightness adjustment and/or color temperature adjustment signal from the 2.4 G wireless transceiver module or a brightness adjustment signal from the 0-10V dimmer, the main control circuit 102 respectively outputs the PWM signal to the brightness adjustment circuit 103 and/or the color temperature adjustment circuit 104 to control the operation of both. Preferably, in the present embodiment, the main control circuit 102 is implemented based on a BK2461 MCU chip U10. Understandably, the main control circuit 102 is connected with an external controller through a 2.4 G RF signal. Preferably, the external controller is an RK419 remote controller; that is, the remote controller is connected with the LED driving power supply 10 through a 2.4 G RF signal, to control the multiple parallel connected LED lamp strings, so as to realize the wireless control/wireless packet control of multiple LED lamps.

In some embodiments, the LED driving circuit 101 comprises AC/DC constant voltage circuit 1010 and a Buck step-down constant current circuit 1015. Preferably, the AC/DC constant voltage circuit 1010 is an existing flyback switching power supply circuit, for converting AC power into constant-voltage DC power, which comprises a rectifier and filter circuit 1011 and a constant voltage circuit 1012 sequentially connected between the output end of AC power supply and the Buck step-down constant current circuit 1015. The Buck step-down constant current circuit 1015 is used to provide a stable constant current drive for the LED light source 12 and comprises a driving chip U1, an inductor L3, a capacitor C3, a resistor R27, and a transistor Q2, a diode D16, a diode D18, and a short-circuit protection circuit 1013. Wherein, an input pin (pin 4, pin ACTL) of the driving chip U1 is connected to the output end of the brightness adjustment circuit 103, and an output pin of the driving chip U1 (pin 6, pin SENSE) is connected to one end of the inductor L3, and the other end of the inductor L3 is connected to the input end of the short-circuit protection circuit 1013 and one end of the capacitor C3, and the other end of the capacitor C3 is connected to the output of the short-circuit protection circuit 1013 and the anode of the diode D18, and the one end of the capacitor C3 connected to the inductor L3 is being as the positive output OUT+ of the LED driving circuit 101, and the other end of the capacitor C3 is being as the negative output OUT− of the LED driving circuit 101, and one end of the resistor R27 is connected to a driving pin (pin 3, pin GATE) of the driving chip U1, and the other end of the resistor R27 is connected to the gate of the transistor Q2 and the cathode of the diode D16, and the drain of the transistor Q2 is connected to the positive output V+ of the constant voltage circuit 1012 of the AC/DC constant voltage circuit 1010. Preferably, the drain of the transistor Q2 could also be connected to the positive output OUT+ of the LED driving circuit 101 through a capacitor C20. The source of the transistor Q2, the cathode of the diode D18 and the anode of the diode D16 are all connected to ground; wherein the positive output OUT+ of the LED driving circuit 101 is connected to the anode of the LED lamp strings. Preferably, the model of the driving chip U1 is RT8458.

In the present embodiment, the short-circuit protection circuit 1013 comprises a resistor R68, a resistor R66, and a zener diode ZD1, and one end of the resistor R68 is connected to the positive output OUT+ of the LED driving circuit 101, and the other end is connected to one end of the resistor R66 and the cathode of the zener diode ZD1. The other end of the resistor R66 and the anode of the zener diode ZD1 are both connected to the negative output OUT− of the LED driving circuit 101. In the present embodiment, the cathode of the zener diode ZD1 is set as the short-circuit detection point A1, and the MCU U10 detects the voltage of the point A1.

In some embodiments, the Buck step-down constant current circuit 1015 further comprises a sampling circuit 1014. The sampling circuit 1014 comprises at least one sampling resistor. One end of the sampling resistor is connected to an output pin (pin 6, pin SENSE) of the driving chip U1, and the other end of the sampling resistor is connected to the ground. As can be seen from the figures, in the present embodiment, the sampling circuit 1014 comprises five sampling resistors, that's a resistor R38, a resistor R39, a resistor R40, a resistor R41 and a resistor R63. Understandably, in some other embodiments, the number and the resistor parameters of the sampling resistors may be set according to actual requirements.

In some embodiments, the brightness adjustment circuit 103 comprises a photocoupler, a resistor R26, a resistor R34, a resistor R35, a resistor R36, a capacitor C14 and a capacitor C15; wherein, one end of the resistor R34 is connected to an output pin (pin 21) of the MCU U10 of the main control circuit 102, and the output pin (pin 21) is set as the pin PWM2, and the other end of the resistor R34 is connected to the anode of the light-emitting diode of the photocoupler, the cathode of the light-emitting diode of the photocoupler is connected to the negative output OUT− of the LED driving circuit 101, and one end of the resistor R35 is connected to an emitter of the phototransistor of the photocoupler, and the other end of the resistor R35 is connected to one end of the capacitor C14 and one end of the resistor R36, and the other end of the resistor R36 is connected to one end of the capacitor C15 and an input pin (pin 4, pin ACTL) of the driving chip U1 of the LED driving circuit 101, and the other end of the capacitor C14 and the other end of the capacitor C15 are both connected to the ground, and a collector of the phototransistor of the photocoupler is connected to one end of the resistor R26, and the other end of the resistor R26 is connected to the power supply VCC, and the power supply VCC is provided by the LED driving circuit 101. Based on the above design, the resistor R35, the resistor R36, the capacitor C14 and the capacitor C15 constitute a filter circuit, and after receiving the brightness adjustment signal of the external controller, the main control circuit 102 of the present application changes the duty cycle of the pin PWM2 connected to the brightness adjustment circuit 103, and the effective value of the filter circuit could be changed, thereby changing the voltage of the pin ACTL of the driving chip U1 of the LED driving circuit 101 connected to the output end of the filter circuit, thereby changing the current input to the LED lamp string, so as to achieve the brightness adjustment of the LED light source 12.

In the present embodiment, the brightness adjustment circuit 103 further comprises a voltage stabilizing circuit 1031. The voltage stabilizing circuit 1031 comprises a triple pin regulator U3 and a resistor R33. The cathode (pin 2) and the reference electrode (pin 1) of the triple pin regulator U3 and one end of the resistor R33 are all connected to the emitter of the phototransistor of the photocoupler, and the anode (pin 3) of the triple pin regulator U3 and the other end of the resistor R33 are both connected to the ground. In some embodiments, the brightness adjustment circuit 103 further comprises a capacitor C13 and a resistor R37. One end of the capacitor C13 is connected to the collector of the phototransistor of the photocoupler, and one end of the resistor R37 is connected between the resistor R36 and the capacitor C15, and the other end of the capacitor C13 and the other end of the resistor R37 are both connected to the ground. Preferably, the model of the triple pin regulator U3 is TL431.

It can be known that the present application could use the 0-10V dimmer to adjust the brightness of the lamp, and could also use an external remote controller to adjust the brightness. When a 0-10V dimmer is used to adjust the brightness, by adjusting the 0-10V dimmer, the output voltage of the 0-10V dimmer circuit could be changed, and the MCU U10 detects the output voltage to adjust the duty cycle of the pin PWM2 connected to the brightness adjustment circuit, thereby changing the current input to the LED lamp string; and when an external remote controller is used to adjust the brightness, the MCU U10 receives the brightness adjustment signal from the 2.4 G remote controller. After decoding, the MCU U10 directly adjusts the duty cycle of the pin PWM2 connected to the brightness adjustment circuit according to the decoded information, thereby changing the current input to the LED lamp string.

In the embodiment shown in the drawings, the LED light source 12 is composed of two set of LED lamp strings with different color temperatures connected in parallel. Accordingly, the color temperature adjustment circuit 104 comprises two switching circuits 1041. The structure of each switching circuit 1041 is the same, and a switching circuit 1041 is correspondingly connected to an LED lamp string, and adjusting the conduction duty cycle of each switching circuit 1041 to adjust the current input to each LED lamp string could achieve color temperature adjustment of the LED light source 12. The switching circuit 1041 comprises a driving chip, an eleventh resistor, a twelfth resistor, a fourth transistor, an electrolytic capacitor and a filter capacitor. The input pin (pin 6) of the driving chip is connected to an output pin (pin 19) of the main control circuit 102, and the output pin (pin 19) is set as the pin PWM1, and an output pin of the driving chip is connected to one end of the eleventh resistor, and the other end of the eleventh resistor is connected to one end of the twelfth resistor and the gate of the fourth transistor, and the drain of the fourth transistor is connected to the cathode of the LED lamp string, one end of the filter capacitor and the cathode of the electrolytic capacitor, and the anode of the electrolytic capacitor is connected to the positive output OUT+ of the LED driving circuit 101, and the source of the fourth transistor, the other end of the filter capacitor and the other end of the twelfth resistor are all connected to the negative output OUT− of the LED driving circuit 101. Preferably, the model of the driving chip of the present embodiment is MX321. Preferably, in the present embodiment, the switching circuit 1041 further comprises a thirteenth resistor, and the input pin (pin 6) of the driving chip is connected to the pin PWM1 of the main control circuit 102 through the thirteenth resistor. Based on the design, when the duty cycle of the pin PWM1 of the main control circuit 102 increases, the conduction duty cycle of the fourth transistor of the switching circuit 1041 connected to the pin PWM1 decreases, and then the current flowing through the LED lamp string connected to the switching circuit 1041 decreases, so the lamp beads of the LED lamp string become darkened, and the adjustment of the duty cycle of the pin PWM1 is a linear adjustment, and the range of the adjustment is 0-100%, therefore, the brightness of the LED lamp string changes very smoothly, which could achieve linear stepless adjustment of color temperature.

In some embodiments, the ground pin (pin 5 and pin 2) of the driving chip is connected to the negative output OUT− of the LED driving circuit 101, and the power supply pin (pin 1) of the driving chip is connected to the negative output OUT− of the LED driving circuit 101 through a capacitor, and the power supply pin (pin 1) is also connected to the power supply VDD.

Figure 3:
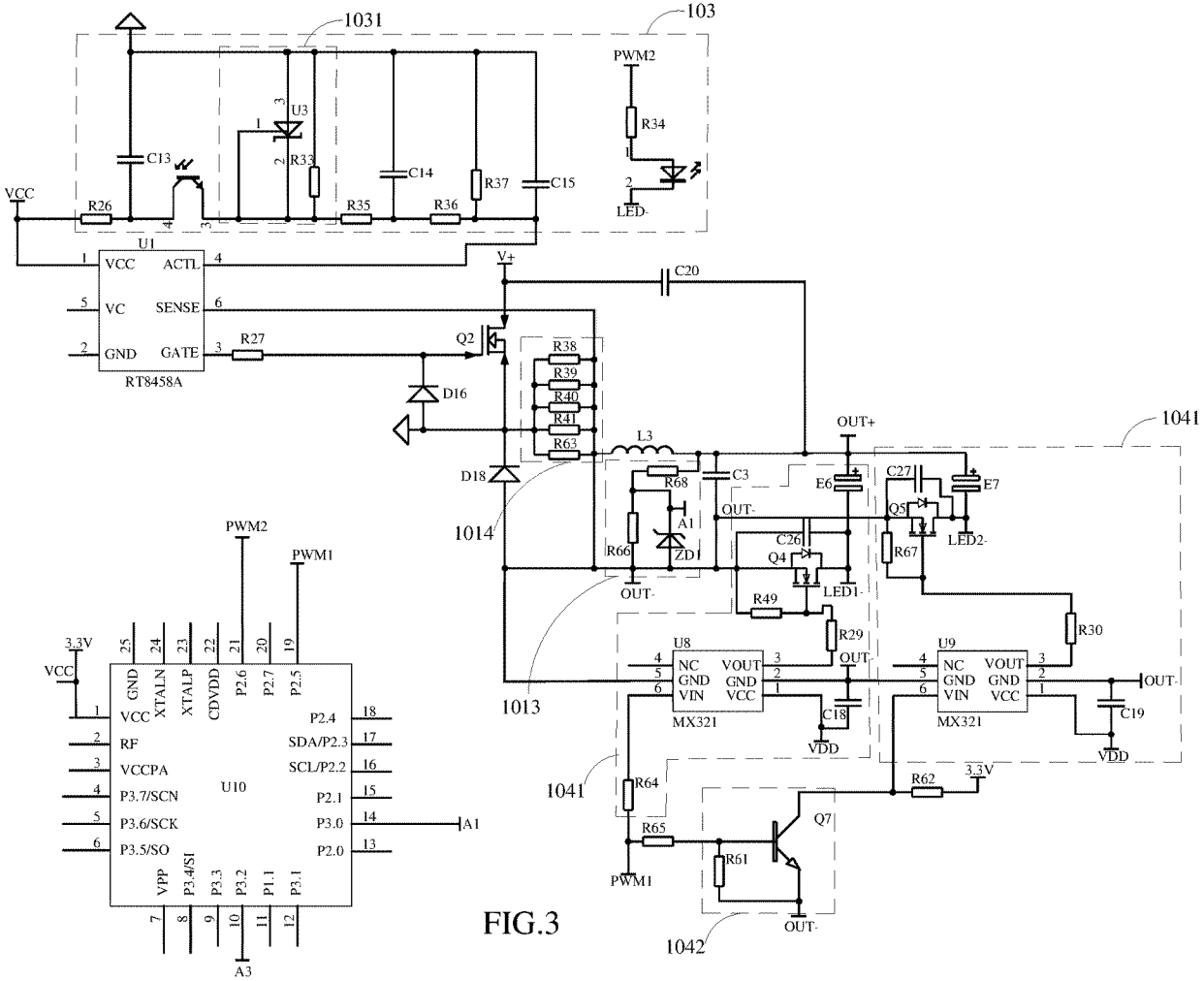
FIG. 3 is a specific circuit diagram of the main control circuit, the brightness adjustment circuit, Buck step-down constant current circuit in the LED driving circuit, and the color temperature circuit of the present application.
Figure 4:
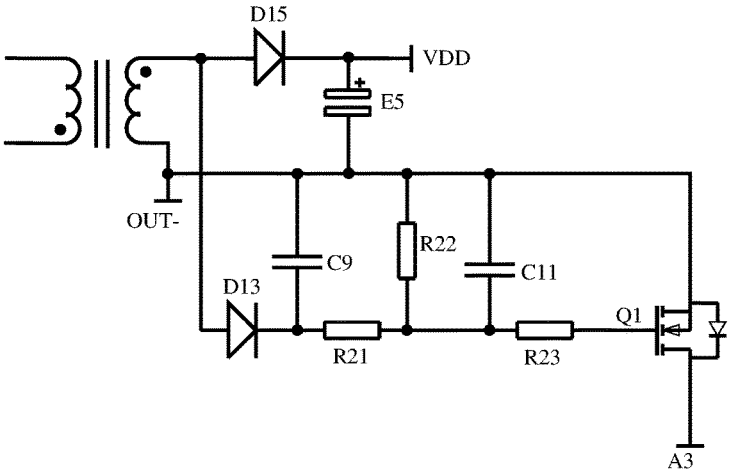
FIG. 4 is a specific circuit diagram of a power switch detecting circuit of the present application.

Specifically, as shown in FIG. 3, in the present embodiment, one switching circuit 1041 comprises a driving chip U8, a resistor R64, a resistor R29, a resistor R49, a transistor Q4, a filter capacitor C26 and an electrolytic capacitor E6. The drain of the transistor Q4 is connected to the cathode of one set of LED lamp string (e.g., LED 1). One end of the resistor R29 is connected to an output pin (pin 3) of the U8, and the power supply pin (pin 1) of the driving chip U8 is connected to the negative output OUT− of the LED driving circuit 101 through an capacitor C18. The other switching circuit 1041 comprises a driving chip U9, a resistor R65, a resistor R30, a resistor R67, a transistor Q5, a capacitor C27 and an electrolytic capacitor E7. The drain of the transistor Q5 is connected to the cathode of the other set of LED lamp string (e.g., LED 2). One end of the resistor R30 is connected to an output pin (pin 3) of the U9, and the power supply pin (pin 1) of the driving chip U9 is connected to the negative output OUT− of the LED driving circuit 101 through a capacitor C19.

Preferably, the color temperature adjustment circuit 104 further comprises a flip circuit 1042. The flip circuit 1042 comprises a resistor R61 and a transistor Q7. One end of the resistor R61 and a base of the transistor Q7 are both connected to the pin PWM1 of the main control circuit 102 through the resistor R65, and a collector of the transistor Q7 is connected to the input pin (pin 6) of the driving chip U9 of the corresponding switching circuit 1041, and an emitter of the transistor Q7 and the other end of the resistor R61 are both connected to the negative output OUT− of the LED driving circuit 101. In the present embodiment, the collector of the transistor Q7 is also connected to a power supply of 3.3V through a resistor R62. Based on the above design, after receiving the color temperature adjustment signal from an external controller, the main control circuit 102 changes the duty cycle of the pin PWM1, and one signal of the pin PWM1 is used to drive the transistor Q4 through the driving chip U8, and another signal of the pin PWM1 is flipped by the transistor Q7 of the flip circuit 1042 and then is used to drive the transistor Q5 through the driving chip U9, so the output of the transistor Q4 and the output of the transistor Q5 are kept in a complementary state, so as to keep the output power constant in the process of adjusting the color temperature; when the duty cycle of the pin PWM1 increases, the conduction duty cycle of the transistor Q4 decreases and the conduction duty cycle of the transistor Q5 increases, then the effective value of the current flowing through the LED 1 decreases and the lamp beads of the LED 1 become darkened, and the effective value of the current flowing through the LED 2 increases and the LED beads in LED 2 become brighter.

Person skilled in the art could understand that, in other embodiments, when the LED light source 12 comprises multiple sets of LED lamp strings with different color temperatures, accordingly, the number of the switching circuit 1041 of the color adjustment circuit 104 is set to be the same as the number of LED lamp strings, so that one switching circuit 1041 is correspondingly connected to one set of LED lamp string, and all the switching circuits 1041 are connected to the main control circuit 102, so that the main control circuit 102 could use the switching circuit 1041 to control the current flowing into the LED lamp string corresponding connected to the switching circuit, so as to adjust the color temperature of the LED light source 12.

Understandably, if the LED light source 12 comprises a first set of LED lamp string with a color temperature of 6000K and a second set of LED lamp string with a color temperature of 3000K. The color temperature adjustment circuit 104 comprises two switching circuits 1041, that's a first switching circuit and a second switching circuit. The first switching circuit is connected to the first set of LED lamp string, and the second switching circuit is connected to the second set of LED lamp string. If the fourth transistor of the first switching circuit is turned on, the light emitted by the LED light source 12 is white light with color temperature of 6000K; if the fourth transistor of the second switching circuit is turned on, the second set of LED lamp string emits light and the light emitted by the LED light source 12 is yellow light with color temperature of 3000K; if both of the fourth transistor of the first switching circuit and the fourth transistor of the second switching circuit are turned on, both of the first set of LED lamp string and the second set of LED lamp string emit light, and at this time, the light emitted by the LED light source 12 is similar to sunlight with color temperature of 4500K obtained by mixing 6000K and 3000K; if the conduction duty cycle of the fourth transistor of the first switching circuit and the conduction duty cycle of the fourth transistor of the second switching circuit are different, the light brightness of the first set of LED lamp string and the light brightness of the second set of LED lamp string are different, thereby changing the color temperature of the LED light source 12. Similarly, if there are multiple sets of LED lamp strings with different color temperatures, the color temperature adjustment circuit 104 comprises multiple of switching circuits 1041 with the number same as the LED lamp strings, and multiple sets of LED lamp strings with different color temperatures could constitute many different combinations, so as to obtain many different color temperatures.

In the present embodiment, the LED driving power supply 10 further comprises a power switch S connected between the output end of the AC power supply and the LED driving circuit 101, and a power switch detecting circuit 105 for detecting the working state of the power switch S. The main control circuit 102 obtains the voltage of an output end of the power switch detecting circuit 105 to adjust the color temperature of the LED lamp strings. Preferably, the power switch detecting circuit 105 comprises a secondary winding coupled to a primary winding of a transformer (i.e., a transformer connected to a PWM controller through a MOS transistor in a flyback switching power supply circuit) of the constant voltage circuit 1012, and a diode D13, a capacitor C9, a resistor R21, a resistor R22, a capacitor C11, and a resistor R23 and a transistor Q1, which are all connected to the secondary winding; wherein, a dotted terminal of the secondary winding is connected to the anode of the diode D13, and the cathode of the diode D13 is connected to one end of the capacitor C9 and one end of the resistor R21, and the other end of the resistor R21 is connected to one end of a resistor R22, one end of the capacitor C11 and one end of the resistor R23, and the other end of the resistor R23 is connected to a gate of the transistor Q1, and a drain of the transistor Q1 (set as the pin A3) is connected to an input pin (pin 10) of the MCU U10 of the main control circuit 102, and a heteronymous terminal of the secondary winding is connected to the other end of the capacitor C9, the other end of the resistor R22, the other end of the capacitor C11 and the source of the transistor Q1, and is also connected to the negative output OUT− of the LED driving circuit 101. In some embodiments, the power switch detecting circuit 105 further comprises a diode D15 and an electrolytic capacitor E5. The anode of the diode D15 is connected to the dotted terminal of the secondary winding, and the cathode of the diode D15 is connected to the anode of the electrolytic capacitor E5, and the cathode of the electrolytic capacitor E5 is connected to the heteronymous terminal of the secondary winding. Based on the design, the main control circuit 102 could change the duty cycle of the pin PWM1 connected to the color temperature circuit 104 by detecting the state of the power switch S, so as to adjust the color temperature of the lamp string. That is, the MCU U10 changes the duty cycle of the pin PWM1 connected to the color temperature circuit 104 by detecting the output of the drain (pin A3) of the transistor Q1; D13, C9, R21, R22, C11, and R23 form an RC charge and discharge circuit, and due to the charge and discharge characteristics of the capacitor, when the power switch S is opened and then is closed within 5 seconds, the charge at two ends of the capacitor C11 is not completely discharged, thereby existing voltage, to make the transistor Q1 be turned on. If the MCU U10 detects that the output of the drain of the transistor Q1 is a low level, the MCU U10 changes the effective value of the current flowing through the LED lamp string by changing the duty cycle of the pin PWM1, so as to change the color temperature; when the power switch S is opened and then is not closed within 5 seconds, the charge at two ends of the capacitor C11 is completely discharged, and at the moment of power on again, the capacitor C11 is charged through the resistor R21, and the charge time is about 3 seconds, however, the MCU U10 will detect the output of the drain of the transistor Q1 upon power on, and the output of the drain of the transistor Q1 is a high level at the moment of power on, therefore, the MCU U10 will not switch the color temperature of the LED lamp string, but keep the color temperature as that before power off.

In summary, the present application realizes the brightness adjustment and color temperature adjustment of the LED driving power supply of the present application through 2.4 G remote control, that is, the main control circuit integrates a 2.4 G wireless transceiver module, and could connect with the external controller through the 2.4 G RF signal, and according to the brightness adjustment instruction and/or the color temperature adjustment instruction from the external controller, the main control circuit outputs the PWM signal to the brightness adjustment circuit and/or the color temperature adjustment circuit, to realize the stepless adjustment of brightness and the stepless adjustment of color temperature of the multiple LED lamps. The present application remains the traditional 0-10V dimmer, so the present invention could also control the luminous intensity of LED lamp strings according to the change of the voltage of the 0-10V dimmer to realize the brightness adjustment function of the LED, and could also adjust the color temperature of the LED light source by controlling the switching time of the power switch, which could meet the needs of different users and facilitate the daily use of consumers.

The above description is only preferred embodiments of the present application, and does not impose any limitation to the present application. Person skilled in the art may make various equivalent alterations and improvements on the basis of the above embodiments, and all equivalent changes or modifications made within the scope of the claims shall fall into the protection scope of the present application.

What is claimed is:

1. An LED driving power supply based on 2.4 G remote controlling adjustment of brightness and color temperature, comprising:

an LED driving circuit, connected between an output end of an AC power supply and an LED light source, and the LED light source comprises at least two sets of LED lamp strings with different color temperatures connected in parallel;

a brightness adjustment circuit, connected to the LED driving circuit, for adjusting a current input to the LED light source by the LED driving circuit according to a first input PWM signal;

a color temperature adjustment circuit, connected to a loop of the LED driving circuit and the LED light source, for adjusting a current input to each LED lamp string according to a second input PWM signal;

a main control circuit, the main control circuit integrates a 2.4 G wireless transceiver module and is connected to a 0-10V dimmer, and according to a brightness adjustment signal from the 2.4 G wireless transceiver module, the main control circuit outputs the first input PWM signal to the brightness adjustment circuit to control the operation of the brightness adjustment circuit according to a color temperature adjustment signal from the 2.4 G wireless transceiver module, the main control circuit outputs the second input PWM signal to the color temperature adjustment circuit to control the operation of the color temperature adjustment circuit according to the brightness adjustment signal and the color temperature adjustment signal from the 2.4 G wireless transceiver module, the main control circuit outputs the first input PWM signal to the brightness adjustment circuit to control the operation of the brightness adjustment circuit and outputs the second input PWM signal to the color temperature adjustment circuit to control the operation of the color temperature adjustment circuit according to a brightness adjustment signal from the 0~10V dimmer, the main control circuit outputs the first input PWM signal to the brightness adjustment circuit to control the operation of the brightness adjustment circuit.

2. The LED driving power supply based on 2.4 G remote controlling adjustment of brightness and color temperature according to claim 1, wherein the LED driving circuit comprises AC/DC constant voltage circuit and a Buck step-down constant current circuit; wherein the AC/DC constant voltage circuit comprises a rectifier and filter circuit and a constant voltage circuit sequentially connected between the output end of the AC power supply and the Buck step-down constant current circuit; wherein the Buck step-down constant current circuit comprises a driving chip, an inductor, a first capacitor, a first resistor, and a first transistor, a first diode, a second diode and a short-circuit protection circuit; wherein, an input pin of the driving chip is connected to an output end of the brightness adjustment circuit, and an output pin of the driving chip is connected to one end of the inductor, and the other end of the inductor is connected to an input end of the short-circuit protection circuit and one end of the first capacitor, and the other end of the first capacitor is connected to an output of the short-circuit protection circuit and an anode of the second diode, and the one end of the first capacitor connected to the inductor is being as a positive output of the LED driving circuit, and the other end of the first capacitor is being as a negative output of the LED driving circuit, and one end of the first resistor is connected to a driving pin of the driving chip, and the other end of the first resistor is connected to a gate of the first transistor and a cathode of the first diode, and a drain of the first transistor is connected to the positive output of the constant voltage circuit, and a source of the first transistor, a cathode of the second diode and an anode of the first diode are all connected to ground; wherein the positive output of the LED driving circuit is connected to an anode of the LED lamp strings.

3. The LED driving power supply based on 2.4 G remote controlling adjustment of brightness and color temperature according to claim 2, wherein the LED driving power supply further comprises a power switch connected between the output end of the AC power supply and the LED driving circuit, and a power switch detecting circuit for detecting the working state of the power switch, and the main control circuit obtains a voltage of an output end of the power switch detecting circuit to adjust the color temperature of the LED lamp strings.

4. The LED driving power supply based on 2.4 G remote controlling adjustment of brightness and color temperature according to claim 3, wherein the power switch detecting circuit comprises a secondary winding coupled to a primary winding of a transformer of the constant voltage circuit, and a third diode, a second capacitor, a second resistor, a third resistor, a third capacitor, and a fourth resistor and a second transistor; wherein, a dotted terminal of the secondary winding is connected to an anode of the third diode, and a cathode of the third diode is connected to one end of the second capacitor and one end of the second resistor, and the other end of the second resistor is connected to one end of the third resistor, one end of the third capacitor and one end of the fourth resistor, and the other end of the fourth resistor is connected to a gate of the second transistor, and a drain of the second transistor is connected to the main control circuit, and a heteronymous terminal of the secondary winding is connected to the other end of the second capacitor, the other end of the third resistor, the other end of the third capacitor and a source of the second transistor, and is also connected to the negative output of the LED driving circuit.

5. The LED driving power supply based on 2.4 G remote controlling adjustment of brightness and color temperature according to claim 1, wherein the brightness adjustment circuit comprises a photocoupler, a fifth resistor, a sixth resistor, a seventh resistor, an eighth resistor, a fourth capacitor and a fifth capacitor; wherein, one end of the sixth resistor is connected to the main control circuit, and the other end of the sixth resistor is connected to an anode of a light-emitting diode of the photocoupler, a cathode of the light-emitting diode of the photocoupler is connected to a negative output of the LED driving circuit, and one end of the seventh resistor is connected to an emitter of a phototransistor of the photocoupler, and the other end of the seventh resistor is connected to one end of the fourth capacitor and one end of the eighth resistor, and the other end of the eighth resistor is connected to one end of the fifth capacitor and the LED driving circuit, and the other end of the fourth capacitor and the other end of the fifth capacitor are both connected to ground, and a collector of the phototransistor of the photocoupler is connected to one end of the fifth resistor, and the other end of the fifth resistor is connected to a power supply.

6. The LED driving power supply based on 2.4 G remote controlling adjustment of brightness and color temperature according to claim 5, wherein the brightness adjustment circuit further comprises a voltage stabilizing circuit, wherein the voltage stabilizing circuit comprises a triple pin regulator and a ninth resistor, and a cathode and a reference electrode of the triple pin regulator and one end of the ninth resistor are all connected to the emitter of the phototransistor of the photocoupler, and an anode of the triple pin regulator and the other end of the ninth resistor are both connected to the ground.

7. The LED driving power supply based on 2.4 G remote controlling adjustment of brightness and color temperature according to claim 1, wherein the color temperature adjustment circuit comprises at least two switching circuits, and the switching circuits are all connected to the main control circuit, and each switching circuit is correspondingly connected to one LED lamp string.

8. The LED driving power supply based on 2.4 G remote controlling adjustment of brightness and color temperature according to claim 7, wherein the switching circuit comprises a driving chip, an eleventh resistor, a twelfth resistor, a fourth transistor and an electrolytic capacitor; wherein, an input pin of the driving chip is connected to the main control circuit, and an output pin of the driving chip is connected to one end of the eleventh resistor, and the other end of the eleventh resistor is connected to one end of the twelfth resistor and a gate of the fourth transistor, and a drain of the fourth transistor is connected to a cathode of the LED lamp string and a cathode of the electrolytic capacitor, and an anode of the electrolytic capacitor is connected to a positive output of the LED driving circuit, and a source of the fourth transistor and the other end of the twelfth resistor are both connected to a negative output of the LED driving circuit; wherein, the positive output of the LED driving circuit is connected to an anode of the LED lamp string.

9. The LED driving power supply based on 2.4 G remote controlling adjustment of brightness and color temperature according to claim 8, wherein the switching circuit further comprises a filter capacitor, and one end of the filter capacitor is connected to the source of the fourth transistor, and the other end of the filter capacitor is connected to the cathode of the electrolytic capacitor.

10. The LED driving power supply based on 2.4 G remote controlling adjustment of brightness and color temperature according to claim 1, wherein the LED light source comprises two set of LED lamp strings with different color temperatures connected in parallel; accordingly, the color temperature adjustment circuit comprises two switching circuits, and one switching circuit is connected to the main control circuit, and the other switching circuit is connected to the main control circuit through a flip circuit, and each switching circuit is connected to an LED lamp string; wherein, the flip circuit comprises a tenth resistor and a third transistor, and one end of the tenth resistor and a base of the third transistor are both connected to the main control circuit, and a collector of the third transistor is connected to an input end of the corresponding switching circuit, and an emitter of the third transistor and the other end of the tenth resistor are both connected to a negative output of the LED driving circuit.

11. The LED driving power supply based on 2.4 G remote controlling adjustment of brightness and color temperature according to claim 10, wherein the switching circuit comprises a driving chip, an eleventh resistor, a twelfth resistor, a fourth transistor and an electrolytic capacitor; wherein, an input pin of the driving chip is connected to the main control circuit, and an output pin of the driving chip is connected to one end of the eleventh resistor, and the other end of the eleventh resistor is connected to one end of the twelfth resistor and a gate of the fourth transistor, and a drain of the fourth transistor is connected to a cathode of the LED lamp string and a cathode of the electrolytic capacitor, and an anode of the electrolytic capacitor is connected to a positive output of the LED driving circuit, and a source of the fourth transistor and the other end of the twelfth resistor are both connected to a negative output of the LED driving circuit; wherein, the positive output of the LED driving circuit is connected to an anode of the LED lamp string.

12. The LED driving power supply based on 2.4 G remote controlling adjustment of brightness and color temperature according to claim 11, wherein the switching circuit further comprises a filter capacitor, and one end of the filter capacitor is connected to the source of the fourth transistor, and the other end of the filter capacitor is connected to the cathode of the electrolytic capacitor.

* * * * *